US010514033B2

(12) United States Patent
Head et al.

(10) Patent No.: US 10,514,033 B2
(45) Date of Patent: Dec. 24, 2019

(54) SUBMERSIBLE PROGRESSIVE CAVITY PUMP

(71) Applicant: Coreteq Systems Limited, Bagshot Surrey (GB)

(72) Inventors: Philip Head, Virginia Water (GB); Hassan Mansir, Maidenhead (GB)

(73) Assignee: Coreteq Systems Ltd., Surrey (GB)

( * ) Notice: Subject to any disclaimer, the term of this patent is extended or adjusted under 35 U.S.C. 154(b) by 0 days.

(21) Appl. No.: 15/584,332

(22) Filed: May 2, 2017

(65) Prior Publication Data

US 2017/0321695 A1 Nov. 9, 2017

(30) Foreign Application Priority Data

May 3, 2016 (GB) ..... 1607714.1

(51) Int. Cl.
*E21B 43/12* (2006.01)
*F04C 13/00* (2006.01)
*F04C 2/107* (2006.01)

(52) U.S. Cl.
CPC ..... *F04C 13/008* (2013.01); *E21B 43/128* (2013.01); *F04C 2/1071* (2013.01)

(58) Field of Classification Search
CPC combination set(s) only.
See application file for complete search history.

(56) References Cited

U.S. PATENT DOCUMENTS 5,501,580 A * 3/1996 Barrus ..... E21B 43/128 166/107
5,860,864 A * 1/1999 Vukovic ..... E21B 17/05 464/147
7,234,543 B2 * 6/2007 Schaaf ..... E21B 3/02 175/106
2004/0262043 A1 * 12/2004 Schuaf ..... E21B 3/02 175/57

* cited by examiner

*Primary Examiner* — Taras P Bemko
*Assistant Examiner* — Ronald R Runyan
(74) *Attorney, Agent, or Firm* — Fay Sharpe LLP

(57) ABSTRACT

An electric submersible progressive cavity pump assembly is disclosed, which includes an electric motor, a progressive cavity pump, a transmission rotatable by the motor, and a torque isolator coupled between the transmission and the progressive cavity pump, where the torque isolator includes resilient members which accommodate sudden changes in torque.

8 Claims, 5 Drawing Sheets

SUBMERSIBLE PROGRESSIVE CAVITY PUMP

CROSS-REFERENCE TO RELATED APPLICATIONS

This application claims priority to and the benefit of Great Britain Patent Application No. GB1607714.1, filed May 3, 2016, the entirety of which is hereby incorporated by reference as if fully set forth herein.

The present specification relates to electrical submersible progressive cavity pumps, particularly the drive mechanism of electrical submersible progressive cavity pumps.

BACKGROUND

Progressive cavity pumps (PCP) are a common form of artificial lift, they are particularly suited to heavy oils, solids such as sand with the production fluid and high gas oil ratios. They are commonly driven from surface using rods rotated by an electric motor via a gearbox.

SUMMARY

To use the PCP in more challenging wells such as deviated or horizontal it is better to power the PCP using an electrical submersible motor via a gearbox.

However, the transmission suffers from catastrophic failures because of the fluctuating speeds and loads caused by passing solids, liquids and gases though the pump.

The use of PCP pumps driven by conventional electric submersible pump (ESP) motors was first attempted by a Canadian operator in a heavy oil well in 1966, unfortunately with little success, and then to a much greater extent by Russian operators in the 1970s. However, only within the last decade have these downhole drive (DHD) PCP systems been more fully developed and successfully deployed on a commercial basis. Several major ESP vendors now market motors, gear boxes, and other equipment for DHD PCP systems. As a result, these systems have begun to see wider use. The entire surface unit drive system and rod string required in a conventional PCP system are replaced with a DHD unit that typically consists of:

An Electrical submersible motor

A gearbox and flex-shaft assembly

A PCP unit.

A key feature of the DHD systems is the gearbox/seal/flex-shaft assembly. Although various vendors use different designs and configurations for these components, the overall functions are typically the same:

To isolate the motor oil from the well fluids

To provide a speed reduction between the motor and the pump

To isolate the motor and gearbox from the pump's eccentric motion

To support the thrust load generated by the pump

To provide a path for the produced fluid to flow from the wellbore past the motor (i.e., for cooling) to the pump inlet The speed reduction is necessary because the electric motor normally rotates at 3,600, which is much higher than the ideal operating speed for PC pumps. The eccentric motion of the pump is typically absorbed by a specially designed flex-shaft or knuckle joint assembly positioned between the pump and the gear box.

DHD systems offer certain advantages in applications in which neither an ESP nor a rod-driven PCP can be used optimally. For example, PC pumps generally perform better than conventional ESPs in viscous-oil, high-sand-cut, or high-GOR applications. In deviated or horizontal wells, the rod strings required in surface-driven PCP systems create potential for severe wear or fatigue problems, particularly if there is a large differential pressure on the pump. In such cases, a DHD system may offer a better overall solution by combining the pumping capabilities of a PC pump with the benefits of a rodless drive system. Eliminating sucker rods also results in lower flow losses, which may allow less expensive, smaller-diameter production tubing to be used. In addition, there are no backspin safety issues because the rotating parts are all run downhole. A DHD system also eliminates the need for a stuffing box at surface, thereby reducing the potential for leaks. Drawbacks of the DHD systems include:

The additional capital and servicing costs associated with the power cable for the downhole motor Some size restrictions Additional coordination between the ESP and PCP vendors for equipment design, supply, installation, and service (in most cases)

In practice, these systems are normally used only in higher-rate applications because their use in low-productivity wells generally is not economical.

It is imperative to design a DHD system properly because changing equipment once the system has been installed in a well is costly. Once installed, speed control can be achieved only with a variable-frequency drive. It is important to ensure that the cable and seal systems chosen are compatible with the well fluids to prevent premature system failure.

There must be liquid flow past the motor at all times during operation to ensure that the motor is adequately cooled. Typically it is recommend a 0.3 m/s [1 ft/s] minimum liquid flow velocity past the motor, but this recommendation is based on high-water-cut ESP system designs in which the flow is turbulent. With viscous oil, it is possible that the flow will be laminar, even at 0.3 m/s [1 ft/s], which may result in insufficient motor cooling and thus increased potential for motor failure.

Shrouded systems may be used when seating the pump below the perforations is desirable or when the flow velocity past the motor is expected to be too low for adequate cooling. Note, however, there may be additional flow losses through the shroud that should be taken into consideration. During installation of DHD systems, the susceptibility of the power cable to damage is a concern; thus, particularly in directional- and horizontal-well applications, the use of cable protectors is recommended.

In addition, the gearbox can suffer from catastrophic failure because of the fluctuating speeds and loads caused by passing solids, liquids and gases though the pump.

It is therefore the objective of this invention to decouple the rigid coupling of the motor and transmission and the pump.

SUMMARY

According to one aspect of the invention a soft drive is incorporated into the downhole part of a rod driven PCP.

According to another aspect of the invention the soft drive comprises a lead or ball screw which reacts against a stack of Bellville washers and transmits drive to the pump through a slot arrangement.

According to another aspect of the invention an electric motor, connects to a gearbox, connects via a lead or ball screw assembly incorporating a resistance spring and slot connection to a progressive cavity pump.

According to a further aspect of the invention, the motor and gearbox are decoupled from the PCP using a soft drive or torque isolator tool.

According to a further aspect of the invention, the motor and gearbox rotate at a constant speed and any fluctuations are accommodated by the soft drive tool According to a further aspect of the invention, a torque isolator (soft drive tool) protects the transmission from torque spikes generated during the pumping process.

This allows the use of a very high speed motor to minimise its length and cost. The output length of the motor remains constant.

BRIEF DESCRIPTION OF THE DRAWINGS

By way of example the following figures will be used to describe embodiments of the invention.

DETAILED DESCRIPTION

Figure 1:
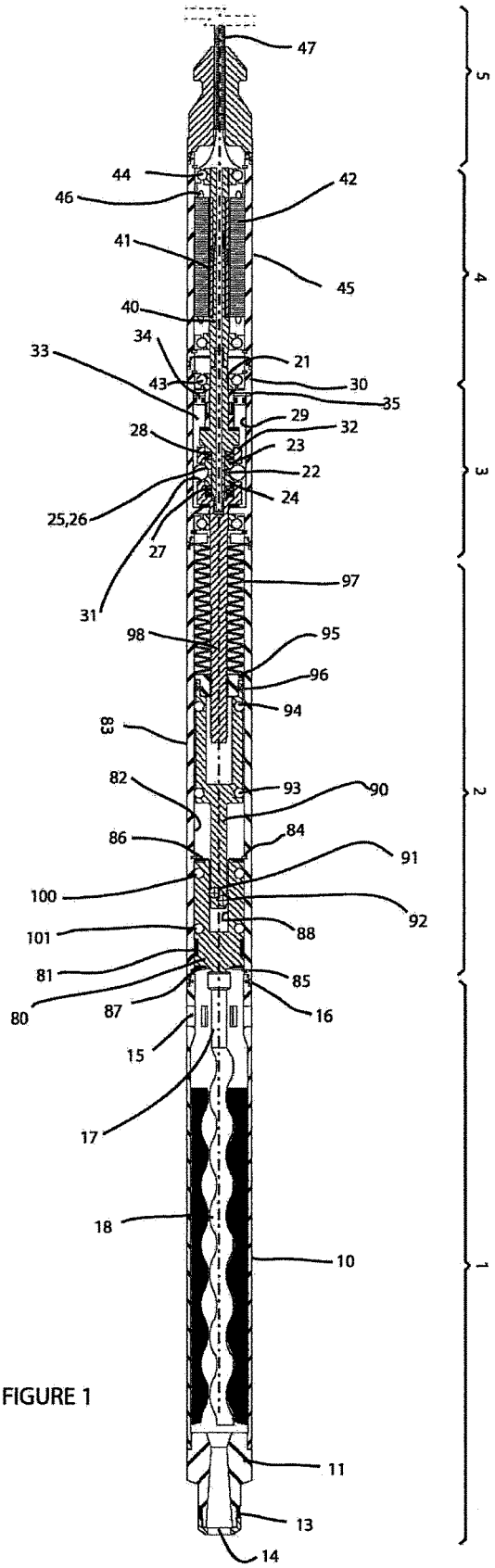
FIG. 1 is a section side view of the umbilical deployed electric powered PCP with a decoupled drive between the transmission and PCP.
Figure 1B:
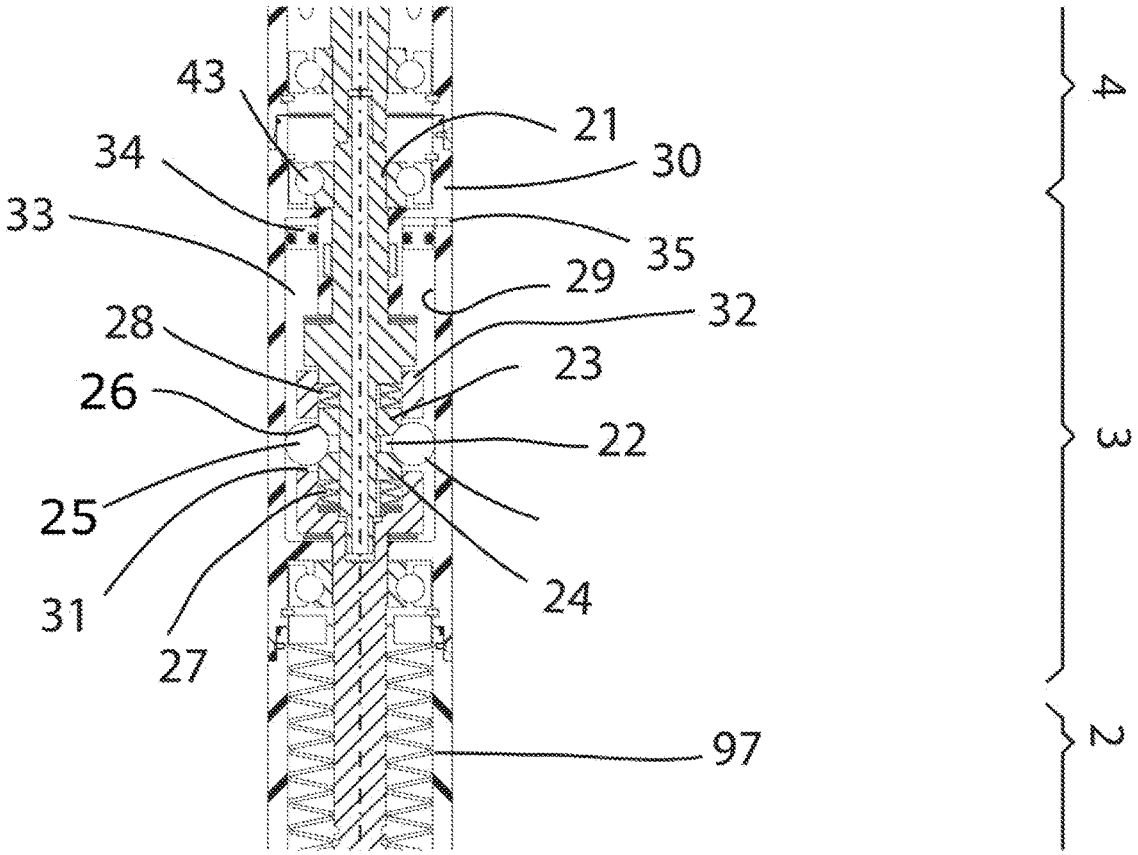
FIG. 1*b* is a section side view of the transmission of FIG. 1 in more detail.
Figure 2:
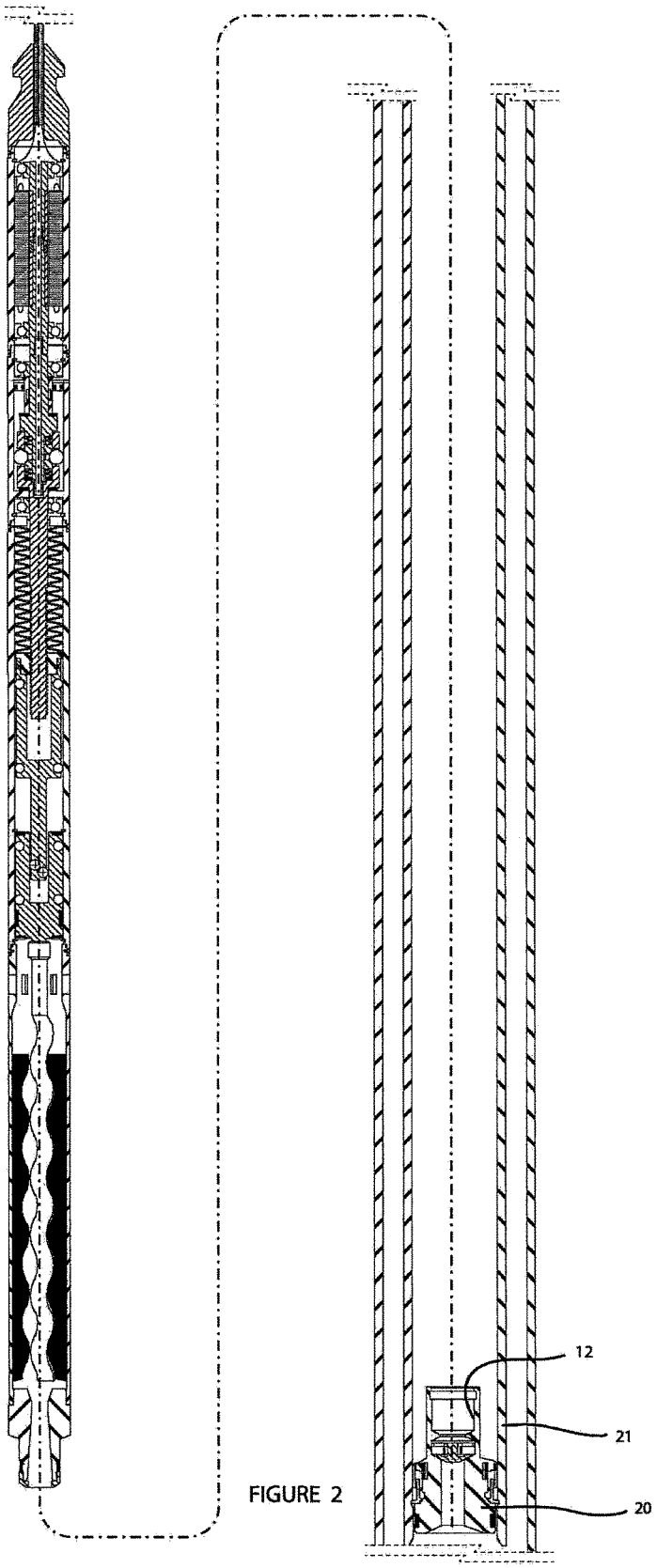
FIG. 2 is section side view of the tool assembly shown in FIG. 1 shown adjacent to the downhole position it would be in the well.
Figure 3:
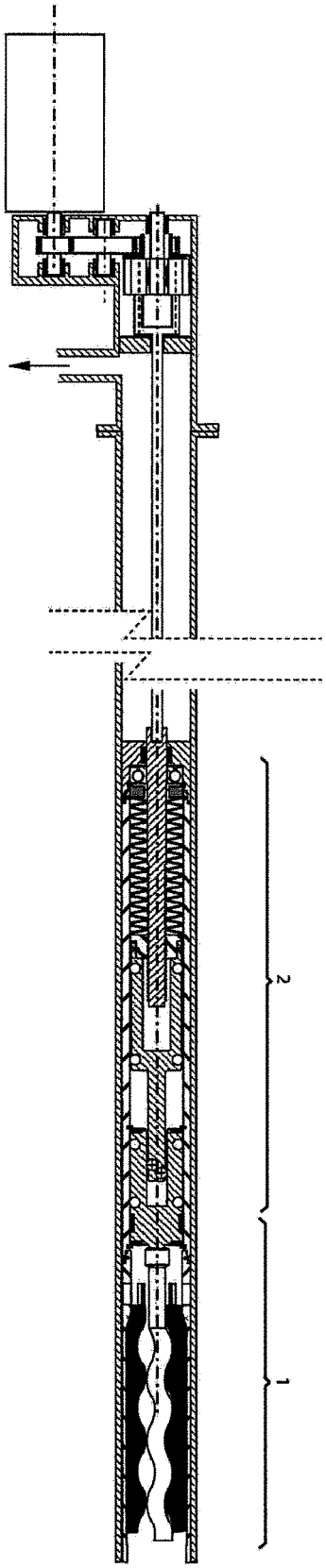
FIG. 3 is a section side view of a well with a surface driven PCP via rods installed down the centre of the production tubing, with the torque isolator tool installed at the lower end of the rods and above the PCP.
Figure 4:
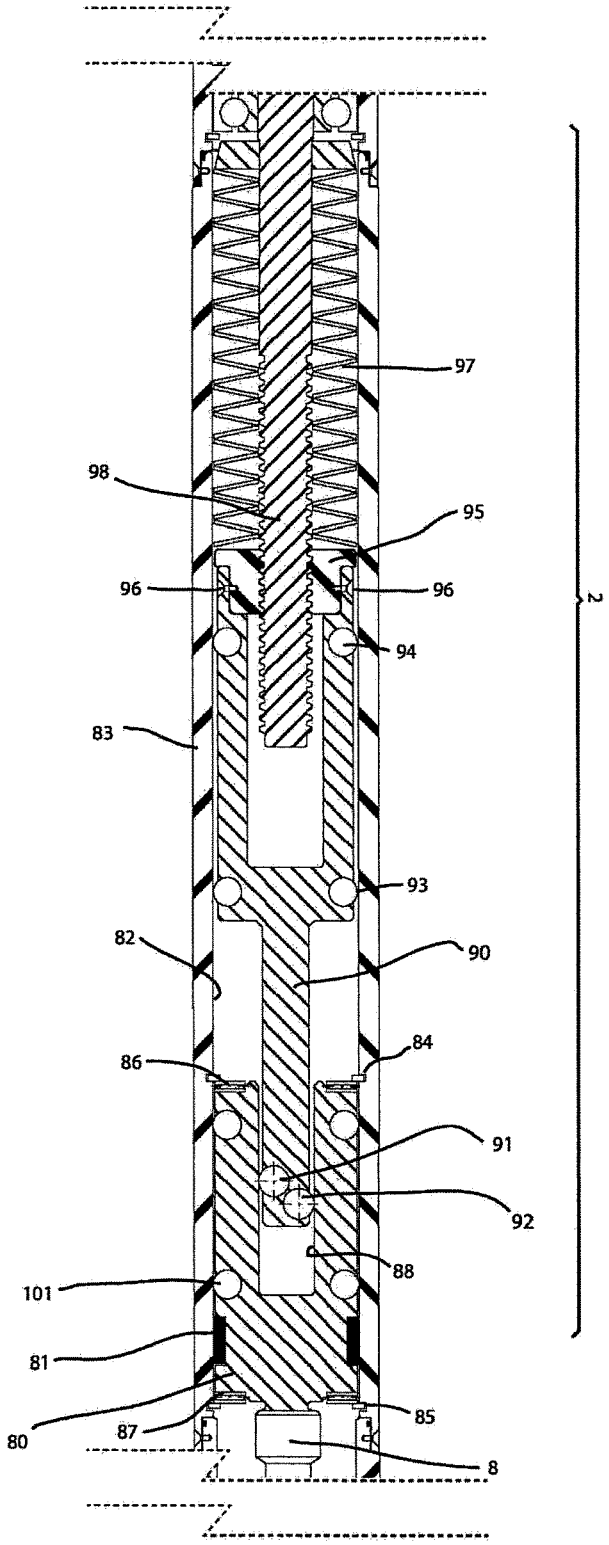
FIG. 4 is a section side view of the torque isolator tool in more detail.

Referring to FIGS. 1 and 4, there is shown an electric pumping assembly consisting of the following sub-assemblies, a progressive cavity pump (PCP) 1, a torque isolator 2, a transmission 3, a permanent magnet motor 4, a telescopic joint 5.

The PCP 1 is a standard type assembly, and consists of an outer housing 10, which connects to a lower housing 11 which stings into a polished bore receptacle 12 and seal 13 isolate the pump inlet 14 from the pump discharge 15. The upper end of the housing is attached to lower housing of the torque isolator tool 2 via a connection assembly 16 The output shaft from the torque isolator 80 connectors to a flexible shaft 17, which in turn rotates the eccentric rotating PCP pump shaft 18.

The torque isolator or soft drive tool 2 has an output spline coupling 8 which engages with the internal spline of the flexible shaft 17. The output shaft 80 has a rotating seal 81 which seals against the bore 82 of the outer housing 83. The output shaft 80 is retained axially by circlips 84 and 85 which act against needle roller bearings 86, 87, and radially by ball bearings 100, 101. A slot 88 is cut into the internal end of the output shaft 80. The output shaft from the lead screw 90 locates in the slot 88 and provides the drive from the lead screw to the output shaft. Needle roller bearings 91, 92 are mounted in the flat section of the lead screw output shaft 90 and reduce the friction between these two running surfaces. The output shaft 90 from the lead screw is supported in the bore 82 by two sets of roller bearings 93, 94, and connects to the lead screw nut 95, by counter sunk screws 96. The lead screw nut reacts against a stack of Bellville washers 97. The lead screw thread 98 is the output shaft of the transmission 3. In normal operation, the motor will be driving the load and the reactive torque will cause the lead screw to compress the Bellville washers until they equal the force generated by the reactive torque. If there are any sudden torque spikes, the Bellville washers will compress some more and then relax again once the spike has passed. The motor and transmission will continue to turn at a constant speed and not "see" any of these detrimental effects.

The transmission 3 employs balls instead of geared teeth. The device consists of an input shaft 21 on which are splines 22 Engaged in these spines are two rings 23, and 24 which have a 45 degree chamfered face 25 which makes a point contact with the balls 26. The rings 23 and 24 are pre-loaded by Bellville washers 27 and 28, which force the balls to contact the inner surface 29 of the outer housing 30. The balls are retained in slots 31 of the planet carrier 32. So in effect, the rings 23 and 24 act as the sun gear, the balls 26 as the planet, and the inner surface 29 of the outer housing as the outer ring. As the input shaft 21 is turned, the balls 26 rotate and drive the output shaft/ball carrier 32. Special transmission oil is used to transmit torque called a traction fluid, which both protect the balls and the running surfaces from wear and also transmit torque as a result of its special properties. More detailed information about these types of traction fluids can be found by referring to one of the following patents U.S. Pat. No. 7,645,395: Variable transmission traction fluid composition, U.S. Pat. No. 6,828,283: Traction fluid with alkane bridged dimer, U.S. Pat. No. 6,623,399: Traction fluids. Many other examples also exist, especially for high temperature applications. This oil is contained in the chamber 33 which also has a pressure compensation piston 34 to equalise the pressure in the chamber with the pressure outside the housing 30 via a communication port 35.

The transmission connects to the output shaft of the permanent magnet motor, this is very conventional in design. It consists of a rotor shaft 40 on which are mounted permanent magnets 41 adjacent to the stator section 42 the shaft is supported both axially and radially at both ends by bearings 43, 44. The stator is retained in the housing 45, and motor windings 46 pass through the stator. The motor is controlled from surface and receives it power through a cable 47 which is also used to lower the assembly into the well. It will also be appreciated, that the assembly could also be run conventionally on the end of tubing with the power cable strapped to the outside of the tubing.

The invention claimed is:

1. An electric submersible progressive cavity pump assembly comprising:

an electric motor;

a progressive cavity pump;

a transmission rotatable by the motor, and coupled to the progressive cavity pump;

the transmission including an upper ring, a set of rolling members, and a lower ring, such that rotation of the upper ring transmits torque to the rolling members, and the set of rolling members transmits torque to the lower ring, the set of rolling members being free to rotate relative to the rotation of the upper ring and the lower ring, wherein the transmission includes resilient members that bear against the rings and compress in response to an increase in torque such that sudden changes in torque are accommodated and not transmitted between the upper ring and lower ring.

2. An electric submersible progressive cavity pump assembly according to claim 1, wherein the transmission accommodates vertical movement between the progressive cavity pump and the motor.

3. An electric submersible progressive cavity pump assembly according to claim 1, including resilient members uphole or downhole the upper ring and/or lower ring, the resilient members being compressible and their compression is proportional to applied torque.

4. An electric submersible progressive cavity pump assembly according to claim 3, wherein the resilient members are Belleville washers.

5. An electric submersible progressive cavity pump assembly according to claim 1, wherein the transmission includes a roller screw or ball screw.

6. An electric submersible progressive cavity pump assembly according to claim 1, wherein the rolling members are balls.

7. An electric submersible progressive cavity pump assembly according to claim 1, wherein the upper ring and/or the lower ring feature chamfered surfaces which abut the rolling members.

8. An electric submersible progressive cavity pump assembly according to claim 1, wherein oil having a high torque transmission is included in the transmission.

* * * * *